US011525337B2

(12) United States Patent
Zhu

(10) Patent No.: US 11,525,337 B2
(45) Date of Patent: Dec. 13, 2022

(54) NOZZLE FOR STEAM INJECTION AND STEAM CHOKING

(71) Applicant: Veriperm Energy Services Inc., Calgary (CA)

(72) Inventor: Da Zhu, Calgary (CA)

(73) Assignee: Variperm Energy Services Inc., Calgary (CA)

( * ) Notice: Subject to any disclaimer, the term of this patent is extended or adjusted under 35 U.S.C. 154(b) by 0 days.

(21) Appl. No.: 17/264,215

(22) PCT Filed: Aug. 12, 2019

(86) PCT No.: PCT/CA2019/051099

§ 371 (c)(1),
(2) Date: Jan. 28, 2021

(87) PCT Pub. No.: WO2020/028994

PCT Pub. Date: Feb. 13, 2020

(65) Prior Publication Data

US 2021/0246764 A1 Aug. 12, 2021

Related U.S. Application Data

(60) Provisional application No. 62/717,576, filed on Aug. 10, 2018.

(51) Int. Cl.
*E21B 41/00* (2006.01)
*E21B 43/08* (2006.01)
(Continued)

(52) U.S. Cl.
CPC ..... *E21B 41/0078* (2013.01); *E21B 43/08* (2013.01); *E21B 43/12* (2013.01); *E21B 43/24* (2013.01)

(58) Field of Classification Search
CPC ..... E21B 43/24; E21B 43/20; E21B 43/12; E21B 43/08; E21B 43/29; E21B 43/14; E21B 7/18; E21B 10/60; E21B 41/0078
See application file for complete search history.

(56) References Cited

U.S. PATENT DOCUMENTS 7,419,002 B2 9/2008 Dybevik
8,496,059 B2 7/2013 Schultz
(Continued)

FOREIGN PATENT DOCUMENTS

CN 101455923 6/2009
CN 107989584 5/2018
(Continued)

OTHER PUBLICATIONS

International Search Report and Written Opinion received for PCT/CA2019/051099 dated Oct. 3, 2019, 9 pgs.
(Continued)

*Primary Examiner* — Yong-Suk (Philip) Ro
(74) *Attorney, Agent, or Firm* — Michael A. Bondi; Moss & Barnett

(57) ABSTRACT

A nozzle for controlling the flow of fluids into and/or out of a hydrocarbon-bearing reservoir comprises a fluid passage extending between first and second openings. The passage comprises a flow adjusting region for increasing the velocity of fluids injected into the reservoir and for choking steam produced from the reservoir.

7 Claims, 2 Drawing Sheets

(51) Int. Cl.
*E21B 43/12* (2006.01)
*E21B 43/24* (2006.01)

(56) References Cited

U.S. PATENT DOCUMENTS

| | | | | |
|---|---|---|---|---|
| 8,689,883 | B2 | 4/2014 | Kim | |
| 8,893,809 | B2 | 11/2014 | Charles | |
| 9,027,642 | B2 | 5/2015 | Sladic | |
| 9,249,649 | B2 | 2/2016 | Fripp | |
| 9,518,455 | B2 | 12/2016 | Franklin | |
| 9,638,000 | B2 | 5/2017 | Dyck | |
| 2005/0077042 | A1 | 4/2005 | Ravensbergen | |
| 2014/0319970 | A1* | 10/2014 | Sherrit ..... | H02N 2/185 310/339 |
| 2018/0045027 | A1 | 2/2018 | Haley | |

FOREIGN PATENT DOCUMENTS

| | | | |
|---|---|---|---|
| WO | 2019213782 | A1 | 11/2019 |
| WO | 2020010449 | A1 | 1/2020 |

OTHER PUBLICATIONS

U.S. Appl. No. 17/054,120, Nozzle for Steam Injection, filed Dec. 2, 2020.
U.S. Appl. No. 17/258,689, Flow Control Nozzle and System, filed Jan. 7, 2021.

* cited by examiner

NOZZLE FOR STEAM INJECTION AND STEAM CHOKING

CROSS REFERENCE TO PRIOR APPLICATIONS

The present description claims priority under the Paris Convention to U.S. Application No. 62/717,576, filed Aug. 10, 2018, and PCT Application No. PCT/CA2019/051099, filed Aug. 12, 2019. The contents of these prior applications is incorporated herein by reference in its entirety.

FIELD OF THE DESCRIPTION

The present description relates to nozzles, or flow control devices, used for controlling flow of fluids into and/or out of a tubular member, in particular a tubular member used for producing hydrocarbons from a subterranean reservoir. In a particular example, the described flow control devices assist in injecting steam from tubing, such as injection tubing, into reservoirs and/or in controlling, or choking, the flow of steam from subterranean formations into tubing, such as production tubing.

BACKGROUND

Subterranean hydrocarbon reservoirs are generally accessed by one or more wells that are drilled into the reservoir to access hydrocarbon materials contained therein. Such materials (or simply "hydrocarbons") are then brought to the surface through tubing, namely production tubing, that is provided within the wells.

The wellbores drilled into the reservoirs may be vertical or horizontal or at any angle there-between. In some cases, where the hydrocarbons comprise relatively viscous materials, such as heavy oil and the like, steam, gas, or other fluids, typically of a lower density, may be injected into one or more sections of the reservoir to stimulate the flow of the hydrocarbons into production tubing provided in the wellbore. Steam Assisted Gravity Drainage, "SAGD", is one example of a process that is used to stimulate the flow of viscous oil. In a SAGD operation, a number of well pairs, each typically comprising a horizontal well, are drilled into a reservoir. Each of the well pairs comprises a steam injection well and a production well, with the steam injection well being positioned vertically above the production well. In operation, steam is injected into the injection well to heat and reduce the viscosity of surrounding hydrocarbon materials, in particular viscous, heavy oil material. After steam treatment, the hydrocarbon material, now mobilized after being heated, drains into the production well located below the injection well by gravity. The hydrocarbons are subsequently pumped to the surface through the production tubing.

Cyclic Steam Stimulation, "CSS", is another hydrocarbon production method where steam is used to enhance the mobility of viscous hydrocarbon materials. In a CSS process, a single well is used to first inject steam into the reservoir through tubing, generally production tubing. After the steam injection stage, the heat from the steam is allowed to be absorbed into the reservoir, a stage referred to as "shut-in" or "soaking", during which the viscosity of the hydrocarbon material is reduced. Following the shut-in stage, the hydrocarbons are brought to the surface, as described above, in a production stage.

Tubing used in wellbores typically comprises a number of segments, or tubulars, that are connected together. Various tools may also be provided along the length of the tubing and positioned in line with adjacent tubulars. The tubing, for either steam injection and/or hydrocarbon production, generally includes a number of apertures, or ports, along its length. The ports provide a means for injection of steam and/or other viscosity reducing agents, and/or for the inflow of hydrocarbon materials from the reservoir into the pipe and thus into the production tubing. The segments of tubing having ports are also often provided with one or more filtering devices, such as sand screens, which serve to prevent or mitigate against sand and other solid debris in the well from entering the tubing.

One of the problems known in the art involves the preferential introduction of steam into production tubing over the desired hydrocarbon material. This generally occurs as steam, or other low density material found in reservoirs, is more mobile than the hydrocarbon material due to its lower density. Further, this problem arises in one or more discrete locations along the length of the production tubing. To address the above-noted problem, steps are often taken to attempt to limit or throttle steam production into the production tubing, and to thereby increase the overall production rate of hydrocarbon materials by increasing the hydrocarbon to steam ratio of the materials brought to the surface. As also known in the art, due to the length of tubing that is used in a typical hydrocarbon well (which may be in the range of several thousand meters), steps must often be taken to ensure that the injection of steam and/or other such materials, where needed, is accomplished generally evenly along the length of the tubing so as to avoid preferential stimulation of one or more regions of the reservoir.

Various nozzles, or flow control devices, have been proposed to control the flow of steam out of and into tubing, such as production tubing. In some cases, a device such as a flow restrictor or similar nozzle is provided on a "base pipe" of the tubing to impede the inflow of steam etc. during the production phase and to accelerate the flow of steam in desired sections during a steam injection phase. Examples of such flow control devices are described in the following references: U.S. Pat. Nos. 9,518,455; 9,638,000; 9,027,642; 7,419,002; 8,689,883; and, 9,249,649, and 8,496,059.

Further flow control nozzles are described in Applicant's co-pending application numbers PCT/CA2019/050636 and PCT/CA2019/050942, the entire contents of which are incorporated herein by reference.

There exists a need for an improved flow control means to control or limit the introduction of steam into production tubing and which can also serve to control the flow of steam from production tubing into a reservoir.

SUMMARY OF THE DESCRIPTION

In one aspect, there is provided a nozzle for controlling flow into or out of a pipe, the pipe having at least one port along its length, the nozzle being adapted to be located on the exterior of the pipe and adjacent one of the at least one port, the nozzle comprising first and second openings and a fluid passage extending there-between, whereby flow of fluid between the first and second openings is controlled.

In one aspect, there is provided a A nozzle for controlling flow into and/or out of a pipe, the pipe having at least one port along its length, the nozzle being adapted to be located on the exterior of the pipe and in fluid communication with one of the at least one port, the nozzle comprising:

a body having a first opening, a second opening, and a fluid conveying passage extending between the first and second openings;

the first opening having a diameter d1 and the second opening having a diameter d4;

wherein, in a first direction extending from the first opening to the second opening, the passageway comprises:

a converging region adjacent to and downstream of the first opening, the converging region having a decreasing cross-sectional area extending in the first direction;

a throat downstream of the converging region, the throat having a diameter d2;

a first diverging region downstream of the throat, the first diverging region having an increasing cross-sectional area extending in the first direction;

a region of generally constant cross-sectional area downstream of the first diverging region, the region of generally constant cross-sectional area having a diameter d3;

a second diverging region downstream of the region of generally constant cross-sectional area, the second diverging region adjacent to the second opening.

In another aspect, there is provided an apparatus for controlling flow of fluid into or out of a subterranean reservoir, the apparatus comprising:

a pipe having at least one port along its length;

at least one nozzle adapted to be located on the exterior of the pipe and in fluid communication with one of the at least one port; and, at least one retainer for retaining the at least one nozzle on the pipe;

wherein the nozzle comprises:

a body having a first opening, a second opening, and a fluid conveying passage extending between the first and second openings;

the first opening having a diameter d1 and the second diameter having a diameter d4;

wherein, in a first direction extending from the first opening to the second opening, the passageway comprises:

a converging region adjacent to and downstream of the first opening, the converging region having a decreasing cross-sectional area extending in the first direction;

a throat downstream of the converging region, the throat having a diameter d2;

a first diverging region downstream of the throat, the first diverging region having an increasing cross-sectional area extending in the first direction;

a region of generally constant cross-sectional area downstream of the first diverging region, the region of generally constant cross-sectional area having a diameter d3;

a second diverging region downstream of the region of generally constant cross-sectional area, the second diverging region adjacent to the second opening.

BRIEF DESCRIPTION OF THE FIGURES

The features of certain embodiments will become more apparent in the following detailed description in which reference is made to the appended figures wherein.

DETAILED DESCRIPTION

Figure 1:
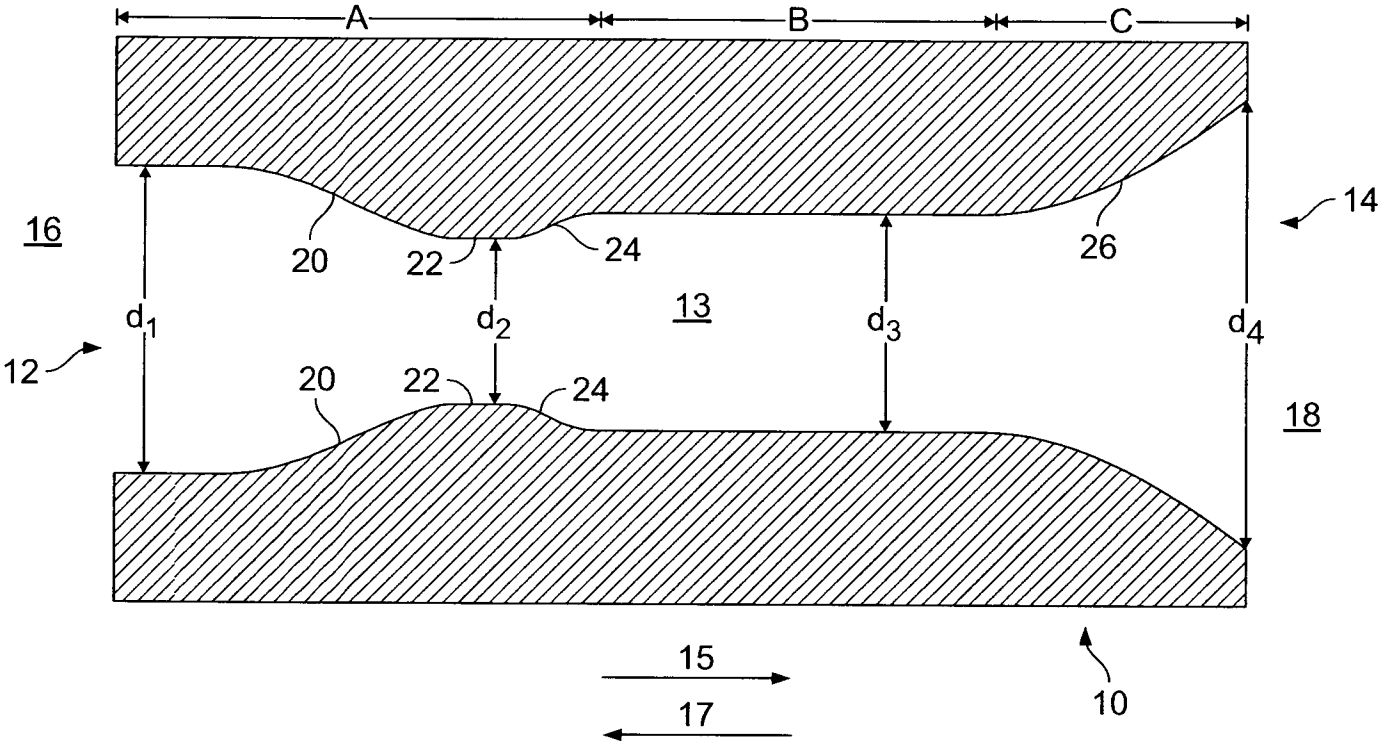
FIG. 1 is a side cross-sectional view of a flow control nozzle according to an aspect of the present description.

As used herein, the terms "nozzle" or "nozzle insert" will be understood to mean a device that controls the flow of a fluid flowing there-through. In one example, the nozzle described herein serves to control the flow of a fluid through a port in a pipe in at least one direction. The nozzle may also be referred to as a "nozzle insert" as such device is often inserted into a slot or the like provided on a base pipe.

The terms "regulate", "limit", "throttle", and "choke" may be used herein. It will be understood that these terms are intended to describe an adjustment of the flow of a fluid passing through the nozzles described herein. As discussed herein, the present nozzles are designed to choke the flow of a low viscosity fluid, in particular steam, flowing from a reservoir into a pipe.

More particularly, as used herein and as would be understood by persons skilled in the art, the flow of a fluid is considered to be "choked" by a restriction when a further decrease in downstream pressure does not result in an increase in the velocity of the fluid flowing through the restriction. That is, the fluid velocity is limited. In the result, and assuming that all other variables remain unchanged, the mass flow rate of the fluid is also limited. Choked flow is also referred to as "critical flow".

The term "hydrocarbons" refers to hydrocarbon compounds that are found in subterranean reservoirs. Examples of hydrocarbons include oil and gas.

The term "wellbore" refers to a bore drilled into a subterranean formation, such as a formation containing hydrocarbons.

The term "wellbore fluids" refers to hydrocarbons and other materials contained in a reservoir that are capable of entering into a wellbore. The present description is not limited to any particular wellbore fluid(s).

The terms "pipe", "base pipe", or "tubular", which may be used interchangeably, each refer to a section of pipe, or other such tubular member. Such tubular member is generally provided with one or more ports or slots along its length to allow for flow of fluids there-through.

The term "production" refers to the process of producing wellbore fluids, in particular, the process of conveying, usually by pumping, wellbore fluids from a subterranean reservoir to the surface.

The term "production tubing" refers to a series of pipes, or tubulars, connected together and extending through a wellbore from the surface into the reservoir.

The terms "screen", "sand screen", "wire screen", or "wire-wrap screen", as used herein, refer to known filtering or screening devices that are used to inhibit or prevent sand or other solid material from the reservoir from flowing into the pipe. Such screens may include wire wrap screens, precision punched screens, premium screens or any other screen that is provided on a base pipe to filter fluids and create an annular flow channel. The present description is not limited to any particular screen described herein.

The terms "comprise", "comprises", "comprised" or "comprising" may be used in the present description. As used herein (including the specification and/or the claims), these terms are to be interpreted as specifying the presence of the stated features, integers, steps or components, but not as precluding the presence of one or more other feature, integer, step, component or a group thereof as would be apparent to persons having ordinary skill in the relevant art.

In the present description, the terms "top", "bottom", "front" and "rear" may be used. It will be understood that the use of such terms is purely for the purpose of facilitating the description of the embodiments described herein. These terms are not intended to limit the orientation or placement of the described elements or structures in any way.

The present description relates to a flow control device, in particular a nozzle, that serves to control or regulate the flow of fluids between a reservoir and a base pipe, or section of production tubing. As discussed above, in one aspect, such regulation is often required in order to preferentially produce hydrocarbon materials over undesired fluids, such as steam. In such cases, the nozzles described herein control, or limit, the flow of fluids from the reservoir into the well (in other words, the production tubing positioned in the wellbore), whereby the hydrocarbon materials are preferentially allowed to enter the tubing. As also discussed above, where steam (or other such less dense and mobile material) is present, it is usually produced in that location instead of the desired hydrocarbon materials, such as heavy oil. The steam, being more mobile than the heavy oil, preferentially travels towards and into the production tubing and, therefore, regulation of steam production is desirable. Regulation of fluid flow is also desirable in situations where steam and/or other fluids (collectively referred to herein as "steam") are injected into the reservoir through the production tubing. In such cases, the nozzles are used to preferably evenly distribute the injected steam over the length of the well so as to avoid preferential production at only a few zones where injection of steam is less hindered. In other words, for the injection stage, the nozzles preferably result in an even steam injection rate along the length of the well.

Generally, the nozzles described herein are adapted to preferably serve a dual function. First, in one aspect, during a steam injection stage, the nozzles serve to achieve critical, or choked, flow of steam and thereby regulate and evenly distribute the mass of steam along the length of the well. Second, in a production stage, the nozzles serve to choke the flow steam from the reservoir into the well (or, production tubing). It should be noted that, while the nozzles described herein are designed to perform the two functions mentioned above, it is not mandatory that they be used for both functions. That is, the nozzles described herein may be used in one or both wells of a SAGD process and thus used for only steam injection or only for hydrocarbon production. Of course, in a CSS process for example, the nozzle, installed on tubing, would perform both functions.

Figure 3:
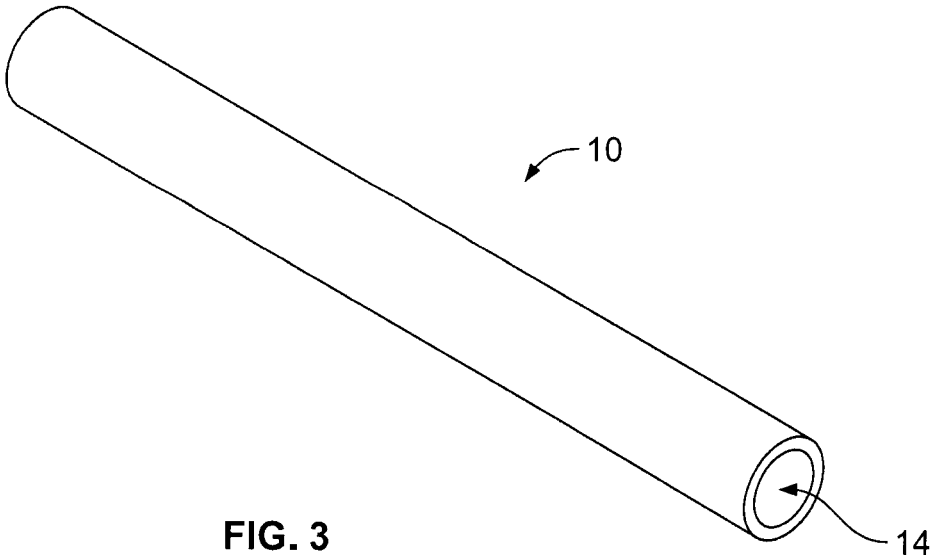
FIG. 3 is a side perspective view of the nozzle of FIG. 1.

FIGS. 1 and 3 illustrates one aspect of a nozzle according to the present description. As known in the art, and as shown in FIG. 3, nozzles such as that shown in FIG. 1 are generally cylindrical structures having a generally constant outer diameter. FIG. 1 illustrates, in cross section, the profile of the lumen of the cylindrical structure. It will also be understood that the nozzle shown in FIGS. 1 and 3 are not drawn to scale. As shown, the nozzle 10 comprises a generally cylindrical body having a first opening 12 and a second opening 14 and a passage 13 extending there-through. The first opening 12 is fluidly connected to the interior of the production tubing, or well, shown by reference to element 16. The second opening 14 is fluidly connected to the reservoir, shown by reference to element 18. Fluid flow through the nozzle 10 occurs in either direction. That is, during the injection stage, steam flows from the production tubing to the reservoir and, therefore from the first opening 12 to the second opening 14. During the production stage, reservoir fluids (i.e. hydrocarbons, steam, etc.) flow from the reservoir to the well, and, therefore, from the second opening 14 to the first opening 12. In both cases, the respective fluids flow through the passage 13.

According to the aspect illustrated in FIG. 1, the passage 13 extending between the first opening 12 and the second opening 14 preferably comprises three regions: (A) a convergent and divergent region, adjacent the first opening 12, and including a throat region, or, simply, a throat; (B) a region of generally constant cross-sectional area; and (C) a second divergent region, adjacent the second opening 14. These regions are discussed further below.

When the nozzle 10 is used in the steam injection stage, steam (which, as described above, may include other additives) from the well or production tubing 16 enters the first opening 12 of the nozzle, adjacent region A. The injected steam flows in the direction of arrow 15, through the passageway 13 in a direction from the first opening 12 to the second opening 14. As shown, in the course of such flow, the steam encounters a converging zone 20, wherein the cross-sectional area of the passageway 13 is narrowed in the direction from the first opening 12 to the second opening 14. As steam flows through the converging zone 20, it will be understood that its velocity increases while its pressure decreases. Following the converging zone 20, the fluid passes through the throat 22, which comprises the region of smallest cross-sectional area in the passageway 13. When the inlet pressure at the first opening 12 is higher than a threshold value (as would be understood by persons skilled in the art), the velocity of the flowing steam approaches the local sonic velocity, i.e. Mach 1, as it passes through the throat 22. Following the throat 22, the fluid enters a diverging zone 24, wherein the cross-sectional area of the passageway 13 expands in the direction from the first opening 12 to the second opening 14. As will be understood, if the inlet pressure is at or higher than the aforementioned threshold value, leading to the velocity of the steam flowing through the throat 22 reaching Mach 1, the velocity of steam passing through the diverging zone 24 will be further accelerated. This effect occurs since, for a compressible fluid such as steam, when the cross-sectional flow area increases, its density decreases faster than the increase in velocity, therefore the area must increase in order to keep a constant mass flow rate. Thus, the diverging zone 24 serves to form a shock wave normal to the direction of flow, which in turn decelerates the steam velocity from supersonic to subsonic speeds, while allowing most of the total pressure to be recovered.

The region of generally constant cross-sectional area, region B, extends for a distance, the purpose of which is discussed further below. As will be understood, the phrase "generally constant cross-sectional area" is intended to mean that the cross-sectional are of this region is generally the same along its length. It will be understood that the actual cross-sectional area will be subject to acceptable tolerances. As such, the cross-sectional area along the length of region B could vary slightly, such as by +/− about 1% to +/− about 10%.

As the flow of steam continues through the passageway 13, and approaches the second opening 14, it enters divergent region C, which comprises a further diverging zone 26, wherein the cross-sectional area of the passageway 13 expands from region B to the second opening 14. As the steam enters the divergent region C, after leaving the constant cross-sectional region B, the steam will be further decelerated, thereby resulting in further pressure recovery.

As shown in FIG. 1, the first opening 12 has a dimension, preferably a radius, d1. Similarly, the throat 22 has a dimension d2, the region B has a dimension d3 and the second opening 14 has a dimension d4. In one aspect, and as illustrated in FIG. 1, d2 is the smallest dimension of nozzle 10, representing the zone of the smallest cross-sectional area of the passageway 13. The dimension of the second opening 14 represents the largest cross-sectional area of the passageway 13. The other dimensions preferably have the following relationships: d2<d3<d1 and d4. In one aspect, as shown in FIG. 1, d2<d3<d1<d4. As will be understood, the specific dimensions of the sections of the passageway will depend on the fluid and reservoir characteristics.

As will be understood, during the production stage when the flow of fluids in the well 16 is reversed, the fluid flow through the nozzle 10 would also be reversed. That is, production fluids, which would include hydrocarbons and in some cases steam, will flow from the reservoir 18, into the second opening 14 and, in the direction indicated by arrow 17, through the passageway 13. The production fluids would then exit the first opening 12 and finally enter the well, or production tubing 16. Thus, as will be understood, such production fluids would encounter the same features of the passageway 13 as discussed above, but in reverse order. Thus, for example, production fluids from the reservoir 18 flowing through the nozzle 10 in the direction 17 would first encounter region C, which serves a constricting zone for the entering production fluids. As would be understood, the velocity of the production fluid flowing through region C is increased while its pressure is decreased.

The production fluid then enters region B, which is the region of generally constant cross sectional area, wherein the reduced pressure of the fluid exiting region C is maintained. In region B, the steam component of the fluid is allowed to separate from the fluid mixture, resulting in more discrete steam and liquid phases. Ideally, during the residence time in region B, the steam is completely or mostly separated from the liquid phase and will reach a state of equilibrium with the water content. This effect is more acute in the case of hot production fluid entering the nozzle 10. Once removed from the rest of the fluid, and into a separate phase, it will be understood that the steam would have an increased velocity as it travels through the nozzle. This increased velocity is believed to serve as a carrier for the liquid phase of the fluid. As will be understood, the increase in velocity that is achieved by the nozzle described herein serves to further increase the pressure drop of the fluid, wherein, according to Bernoulli's principle, such pressure drop is proportional to the square of the flow velocity. In other words, an increase in the fluid velocity results in an exponential increase in the pressure drop of the flowing fluid in region B.

After passing through region B, the production fluid, flowing in the direction of arrow 17, subsequently enters region A, which includes converging region formed by the throat 22. As will be understood, this converging region accelerates the flowing fluid resulting in a further pressure drop. This reduction in pressure would preferably also be sufficient to result in flashing of the steam to occur, particularly in the case where the production fluid is a hot fluid. Region A also serves as an expansion zone prior to the fluid exiting through the first opening 12 of the nozzle 10. The expansion of the production fluid results in a reduction of the fluid velocity and increase in the fluid pressure, that is, pressure recovery.

A further description of the effects of the nozzle 10 on the flow of fluids in either of directions 15 and 17 is provided below. It will, however, be understood that the nozzle 10 described herein generally performs two primary functions. First, during the injection stage, the nozzle 10 serves to inject steam from the well 16 into the reservoir at choked or critical flow conditions. As discussed above, and as would be understood, under such conditions, the velocity of the steam is limited to the local sonic velocity (in particular, Mach 1) at the location of the throat 22 regardless of the pressure differential existing on opposite sides thereof. In the result, the mass flow rate of the injected steam through the throat 22 is also limited, regardless of the pressure differential across the nozzle. In this way, and by selecting the dimensions of the passageway 13, in particular dimension d2, the nozzle 10 is designed to inject steam at a specified and generally uniform mass flow rate once an upstream pressure is reached. Thus, with multiple nozzles being provided over its length, an even distribution of injected steam can be achieved over the length of the well 16 since all nozzles will have a common mass flow rate therethrough.

Second, during the production stage, the nozzle 10 serves to choke back steam present in the production fluids. In this way, the preferential production of steam over the heavier hydrocarbons is limited or avoided.

In the present description, reference is made to the nozzle performing each of the two functions described herein. It will, however, be understood that the description is intended to indicate that the presently described nozzle is capable of performing both functions. In certain cases, the operator of the well or tubing in which the nozzle(s) is(are) used may decide to limit the function of the well to only one of injection or production. In such cases, the nozzles used on such well will only perform one of such functions. Such unilateral use is encompassed by the present description.

Further details of the function of regions, A, B, and C, in terms of both injection and production stages, will now be discussed.

Region A

During the steam injection stage, when the fluid (namely the injected steam and optional additives) flows in the direction of arrow 15, region A serves to accelerate the speed of the steam (which may be dry or wet) to sonic or supersonic speed. As discussed above, in the result, a choked or critical flow of fluid is achieved.

During the production stage, when the fluid (namely the hydrocarbon and/or hydrocarbon and steam emulsion) flows in the direction of arrow 17, region A serves to decelerate the fluid velocity and to recover most of the pressure. In particular, as shown, region A provides an expansion zone where fluid velocity is decreased and its pressure is increased.

Region B

As discussed above, region B comprises a region of generally constant cross-sectional area. During the steam injection stage, the geometry of region B results in the formation of a strong normal shockwave so that fluid flow in the direction of arrow 15 is decelerated across the shockwave thereby resulting in recovery of the fluid pressure.

During the production stage, the fluid exiting region C (which is discussed further below) is allowed to remain at a reduced pressure, thereby resulting in the separation of steam from the fluid, wherein the steam ideally reaches a state of equilibrium with the liquid water. This effect is particularly encountered in the case where the production fluid is a hot fluid. As explained above, the volumetric flow rate, or velocity, of the mixture will be higher through region B due to the existence and separation of the steam. In the result, a greater pressure drop will be generated through region B in view of the pressure drop being proportional to the square of fluid velocity.

Region C

During the steam injection stage, region C serves to reduce the velocity of the fluid prior to exiting the nozzle 10. In the result, the pressure of the steam is substantially recovered.

During the production phase, the flow of the hydrocarbon/steam (i.e. liquid/steam) emulsion is accelerated as it flows in the direction of arrow 17. In the result, the pressure of the fluid is reduced. The resulting pressure drop will, particularly in the case of a hot fluid, result in flashing of the fluid, particularly steam, to occur at the throat 22.

Figure 2:
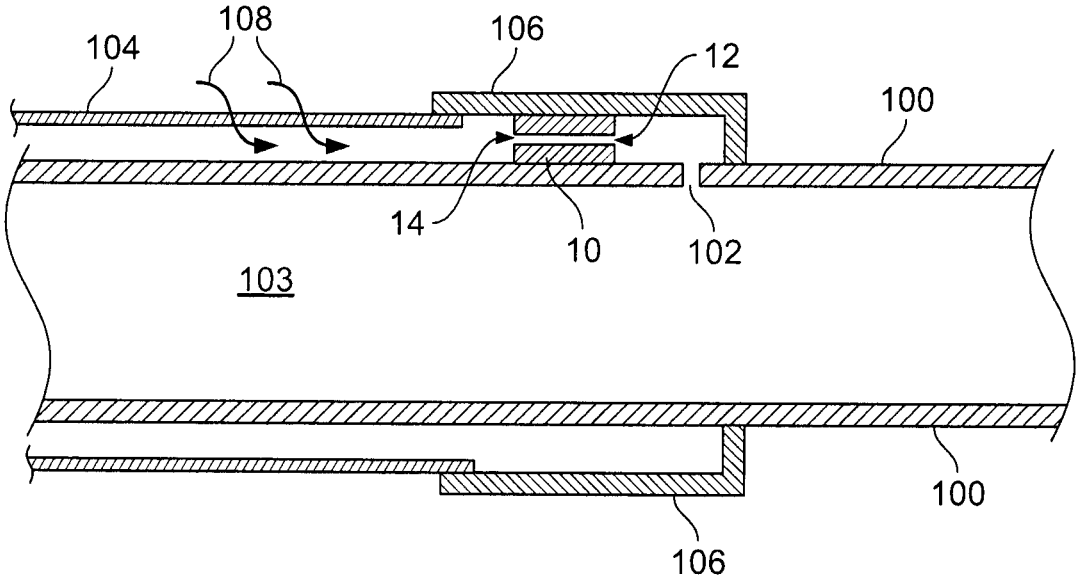
FIG. 2 is a side cross-sectional view of a flow control nozzle according to an aspect of the present description, in combination with a pipe.

FIG. 2 schematically illustrates a pipe that is provided with a nozzle as described herein. As shown, the pipe 100 comprises an elongate tubular body having a number of ports 102 along its length. The ports 102 allow fluid communication between the exterior of the pipe and its interior, or lumen, 103 (which is generally shown as 16 in FIG. 1). As is common, pipes used for production (i.e. production tubing) typically include a screen 104, such as a wire-wrap screen or the like, for screening fluids entering the pipe. The screen 104 serves to prevent or filter sand or other particulate debris from the wellbore from entering the pipe. The screen 104 is provided over the surface of the pipe 100 and is retained in place by a collar 106 or any other such retaining device, retainer, or mechanism. It will be understood that the present description is not limited to any type of screen 104 or screen retaining device, retainer, or mechanism 106. The present description is also not limited to any number of ports 102. Furthermore, it will be appreciated that while the presence of a screen 104 is shown, the use of the presently described nozzle is not predicated upon the presence of such screen. Thus, the presently described nozzle may be used on a pipe 100 even in the absence of any screen 104. As would be understood, in cases where no screen is used, a retaining device, such as a clamp 106 or the like, will be utilized to secure nozzle 10 to the pipe 100. Alternatively, the nozzle 10 may be secured to the pipe in any other manner as would be known to persons skilled in the art.

As shown in FIG. 2, a nozzle according to the present description is shown generally at 10. It will be understood that the illustration of nozzle 10 is schematic and is not intended to limit the structure of the nozzle to any particular shape or structure. Thus, the nozzle 10 of FIG. 2 may consist of the nozzle described above and as shown in FIG. 1 or any other nozzle configuration in accordance with the present description.

As shown in FIG. 2, the nozzle 10 is positioned on the outer surface of the pipe 100 and located proximal to the port 102. It will be understood that the nozzle 10 may be positioned over the pipe 100 in any number of ways. For example, in one aspect, the outer surface of the pipe 100 may be provided with a slot into which the nozzle 10 may be located. The nozzle 10 may be welded or otherwise affixed to the pipe 100 or retained in place with the retaining device 106 as discussed above.

In assembling the apparatus, the pipe 100 is provided with the nozzle 10 and, where needed, the screen 104 and the associated retaining device 106. The pipe 100 is then inserted into a wellbore.

As discussed above, the nozzle 10 is designed for use in both injection and/or production stages. During the injection stage, steam (and any other needed additives) is injected from the surface and allowed to flow through the interior 103 of the pipe 100. The steam then exits the port 102 and enters the first opening 12 of the nozzle 10. After flowing through the passageway 13 of the nozzle 10, the steam exits through second opening 14 and then into the reservoir via the openings in the screen 104 (if present).

During the production stage, wellbore fluids, as shown at 108, pass through the screen 104 (if present) and are diverted to the nozzle 10. The production fluid enters the second opening 14 of the nozzle 10 and flows through the passageway 103 as described above, finally exiting through the first opening 12.

As would be understood by persons skilled in the art, the nozzles described herein are designed to be included as part of an apparatus associated with tubing, an example of which is illustrated in FIG. 2. That is, the nozzles are adapted to be secured to tubing, at the vicinity of one or more ports provided on the tubing. The nozzles are retained in position by any means, such as by collars or the like commonly associated with sand control devices, such as wire wrap screens etc. In another aspect, the present nozzles may be located within slots or openings cut into the wall of the pipe or tubing. It will be understood that the means and method of the securing of the nozzle to the pipe is not limited to the specific descriptions provided herein and that any other means or method may be used, while still retaining the functionality described herein.

It will also be understood that a diverter may be provided between the nozzle opening 12 and the port 102 to direct fluids into or out of the port. In another aspect, such diverter may be an integral component of the nozzle.

As will be understood, although the present description is directed in one aspect to the choking of steam inflow, the presently described nozzles may also be used to choke the flow of other "undesired" fluids such as water and gas or other fluids that injected into the formation such as viscosity modifiers, solvents etc.

Although the above description includes reference to certain specific embodiments, various modifications thereof will be apparent to those skilled in the art. Any examples provided herein are included solely for the purpose of illustration and are not intended to be limiting in any way. In particular, any specific dimensions or quantities referred to in the present description is intended only to illustrate one or more specific aspects are not intended to limit the description in any way. Any drawings provided herein are solely for the purpose of illustrating various aspects of the description and are not intended to be drawn to scale or to be limiting in any way. The scope of the claims appended hereto should not be limited by the preferred embodiments set forth in the above description but should be given the broadest interpretation consistent with the present specification as a whole. The disclosures of all prior art recited herein are incorporated herein by reference in their entirety.

I claim:

1. A nozzle for controlling flow into and/or out of a pipe, the pipe having at least one port along a length of the pipe, the nozzle being adapted to be located on the exterior of the pipe and in fluid communication with one of the at least one port, the nozzle comprising:

a body having first and second ends, a first opening, comprising the first end, a second opening, comprising the second end, and a fluid conveying passage having a longitudinal axis and extending between the first and second openings, the fluid conveying passage being adapted to convey fluid from the first opening to the second opening and from the second opening to the first opening;

the first opening being perpendicular to the longitudinal axis of the fluid conveying passage and having a diameter d1, and the second opening being perpendicular to the longitudinal axis of the fluid conveying passage and having a diameter d4;

wherein, in a first direction extending from the first opening to the second opening, the passageway comprises:

a converging region adjacent to and downstream of the first opening, the converging region having a decreasing cross-sectional area extending in the first direction;

a throat downstream of the converging region, the throat having a diameter d2;

a first diverging region downstream of the throat, the first diverging region having an increasing cross-sectional area extending in the first direction;

a region of generally constant cross-sectional area downstream of the first diverging region, the region of generally constant cross-sectional area having a diameter d3;

a second diverging region downstream of the region of generally constant cross-sectional area, the second diverging region adjacent to the second opening.

2. The nozzle of claim 1, wherein the diameters d1, d2, d3 and d4 have the relationship d2<d3<d1<d4.

3. An apparatus for controlling flow of fluid into or out of a subterranean reservoir, the apparatus comprising:

a pipe having at least one port along a length of the pipe;

at least one nozzle adapted to be located on the exterior of the pipe and in fluid communication with one of the at least one port; and, at least one retainer for retaining the at least one nozzle on the pipe;

wherein the nozzle comprises:

a body having first and second ends, a first opening, comprising the first end, a second opening, comprising the second end, and a fluid conveying passage having a longitudinal axis and extending between the first and second openings, the fluid conveying passage being adapted to convey fluid from the first opening to the second opening and from the second opening to the first opening;

the first opening being perpendicular to the longitudinal axis of the fluid conveying passage and having a diameter d1 and the second opening being perpendicular to the longitudinal axis of the fluid conveying passage and having a diameter d4;

wherein, in a first direction extending from the first opening to the second opening, the passageway comprises:

a converging region adjacent to and downstream of the first opening, the converging region having a decreasing cross-sectional area extending in the first direction;

a throat downstream of the converging region, the throat having a diameter d2;

a first diverging region downstream of the throat, the first diverging region having an increasing cross-sectional area extending in the first direction;

a region of generally constant cross-sectional area downstream of the first diverging region, the region of generally constant cross-sectional area having a diameter d3;

a second diverging region downstream of the region of generally constant cross-sectional area, the second diverging region adjacent to the second opening.

4. The apparatus of claim 3, wherein the diameters d1, d2, d3 and d4 of the nozzle have the relationship d2<d3<d1<d4.

5. The apparatus of claim 4, further comprising a screen over the pipe.

6. The apparatus of claim 3, further comprising a screen over the pipe.

7. The apparatus of claim 6, wherein the retainer retains at least a portion of the screen on the pipe.

* * * * *